US005557806A

United States Patent [19]

Caswell et al.

[11] Patent Number: 5,557,806

[45] Date of Patent: Sep. 24, 1996

[54] WEIGHT-LIFTING GLOVE HAVING A SECURING STRAP AND SLEEVE

[75] Inventors: Charles A. Caswell; Richard K. Davis, both of Altus, Okla.

[73] Assignee: OK-1 Manufacturing Company, Altus, Okla.

[21] Appl. No.: 406,353

[22] Filed: Mar. 17, 1995

[51] Int. Cl.[6] ..... A41D 19/00

[52] U.S. Cl. ..... 2/161.1; 2/162

[58] Field of Search ..... 2/161.1, 161.4, 2/161.2, 161.5, 161.6, 161.7, 162, 169, 160, 159

[56] References Cited

U.S. PATENT DOCUMENTS

| | | | |
|---|---|---|---|
| 425,887 | 4/1890 | Kohler . | |
| 2,154,197 | 4/1939 | Callaway | 2/159 |
| 2,369,115 | 2/1945 | Bloom | 2/16 |
| 2,695,999 | 12/1954 | Arnold | 2/20 |
| 2,794,638 | 6/1957 | Risher et al. | 273/54 |
| 2,952,021 | 9/1960 | Finn | 2/20 |
| 3,031,680 | 5/1962 | Compiano | 2/159 |
| 3,164,841 | 1/1965 | Burtoff | 2/161 |
| 3,344,436 | 10/1967 | Stubbs | 2/159 |
| 3,581,312 | 6/1971 | Nickels | 2/159 |
| 3,606,614 | 9/1971 | Dimitroff | 2/159 |
| 3,643,386 | 2/1972 | Grzyll | 51/391 |
| 3,890,649 | 6/1975 | Diggins | 2/161 |
| 4,057,255 | 11/1977 | Bishop | 273/189 |
| 4,071,913 | 2/1978 | Rector | 2/20 |
| 4,309,991 | 1/1982 | DeMarco | 128/165 |
| 4,400,831 | 8/1983 | Rietz | 2/161 |
| 4,438,532 | 3/1984 | Campanella et al. | 2/16 |
| 4,502,688 | 3/1985 | Papp | 273/189 |
| 4,525,877 | 7/1985 | Chong | 2/161 |
| 4,730,354 | 3/1988 | Saito | 2/161.2 |
| 4,793,005 | 12/1988 | Hetzel, Jr. | 2/161.1 |
| 4,829,604 | 5/1989 | Allen et al. | 2/170 |
| 4,843,651 | 7/1989 | Gramza et al. | 2/161 |
| 4,905,321 | 3/1990 | Walunga | 2/161 |
| 4,958,384 | 9/1990 | McCrane | 2/162 |
| 5,004,231 | 4/1991 | Alread | 2/161.1 X |
| 5,033,120 | 7/1991 | Myers | 2/161.2 X |

*Primary Examiner*—C. D. Crowder
*Assistant Examiner*—Shirra L. Jenkins
*Attorney, Agent, or Firm*—Dunlap & Codding, P.C.

[57] ABSTRACT

A weight-lifting glove having a support strap which is attachable to the bar of a weight to be lifted. The glove includes a glove member and the strap. The glove member has a palm side, a back side, a wrist end, a glove opening at the wrist end, four finger stalls and a thumb stall. Further, a sleeve is provided on the palm side of the glove member. The strap has a free end, an attached end and a running portion. With the hand inserted into the glove member, the running portion of the strap is brought from the wrist through the sleeve to angularly cross the palm side of the glove member. Then the strap is wrapped around the weight-lifting bar or other object to be gripped. Fastener strips are provided on the strap for releasably and adjustably securing the strap around the object to be gripped.

8 Claims, 3 Drawing Sheets

WEIGHT-LIFTING GLOVE HAVING A SECURING STRAP AND SLEEVE

BACKGROUND OF THE INVENTION

1. Field of the Invention

The present invention relates generally to gloves for use in sports and body-building and particularly, but not by way of limitation, to a weight-lifting glove.

2. Description of Related Art

Many types of gloves have been designed for a wide variety of sports and activities. For example, a safety glove for football players is disclosed in U.S. Pat. No. 3,890,649; a basketball training glove is disclosed in U.S. Pat. No. 3,581,312; and a water,skiing glove is disclosed in U.S. Pat. No. 4,400,831.

As other examples, a bowling glove is disclosed in U.S. Patent No. 3,031,680; a sports glove for racquetball is disclosed in U.S. Pat. No. 4,525,877; a golf glove is disclosed in U.S. Patent No. 2,154,197; and a baseball glove is disclosed in U.S. Patent No. 425,887.

With respect to weight-lifting, U.S. Pat. No. 4,843,651, issued to Gramsza et al., discloses a glove with an elastic wrist support strap. U.S. Pat. No. 4,905,321, issued to Walunga, discloses a glove with a detachable wrist support strap. Finally, U.S. Pat. No. 4,958,384, issued to McCrane, discloses a glove with an inelastic wrist support strap.

The Gramsza, Walunga and McCrane straps are constructed to encircle the wrist of a wearer in a shirt cuff fashion. Accordingly, the Gramsza, Walunga and McCrane gloves fail to secure the hand and wrist of the wearer to the object being gripped.

SUMMARY OF THE INVENTION

The present invention is a weight-lifting glove which comprises a glove member and a strap. The glove member has a wrist end, a palm side, a back side, finger stalls and a thumb stall. At the wrist end of the glove member, an opening is provided to receive the hand of the glove wearer.

The strap has a free end, an attached end and a running portion between the attached end and the free end. A sleeve is provided on the palm side of the glove member. The glove is used by bringing the running portion of the strap through the sleeve and then securing the running portion of the strap to the object being gripped.

One object of the present invention is to provide a weight-lifting glove having a strap which supports both the hand and wrist of the wearer.

Another object of the present invention is to provide a weight-lifting glove having a strap which secures the hand of the wearer to the weight being lifted by the wearer.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
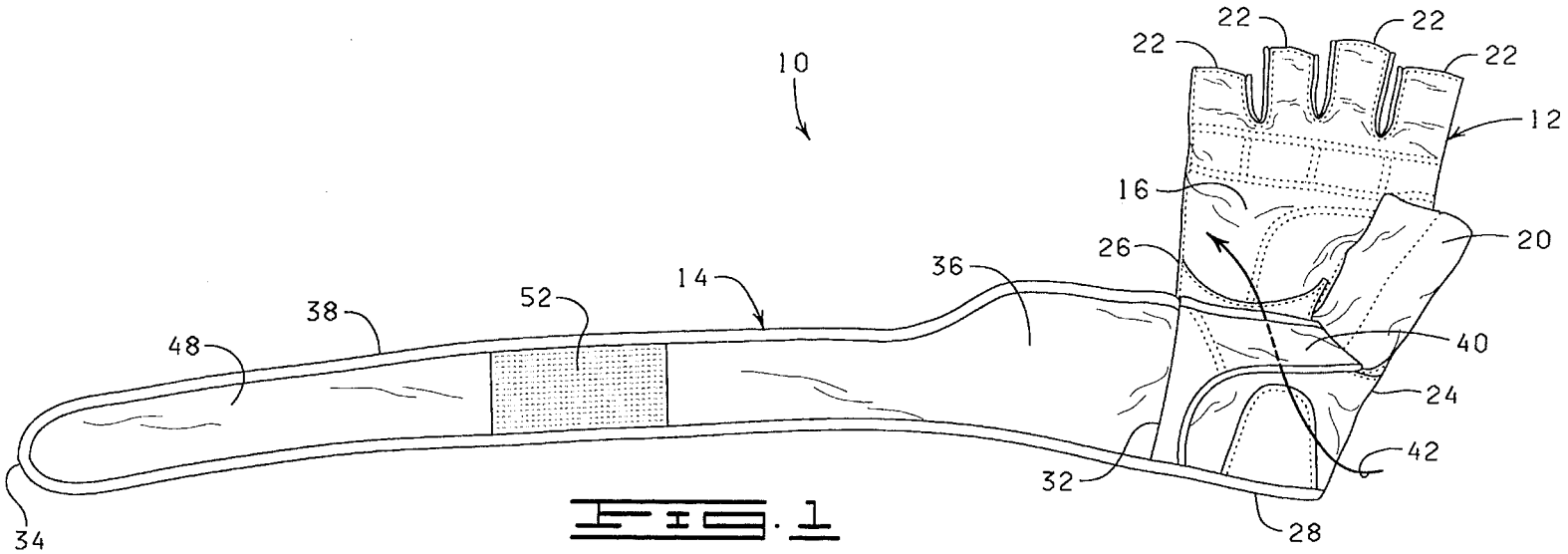
FIG. 1 is a palm side view of a weight-lifting glove constructed in accordance with the present invention.
Figure 2:
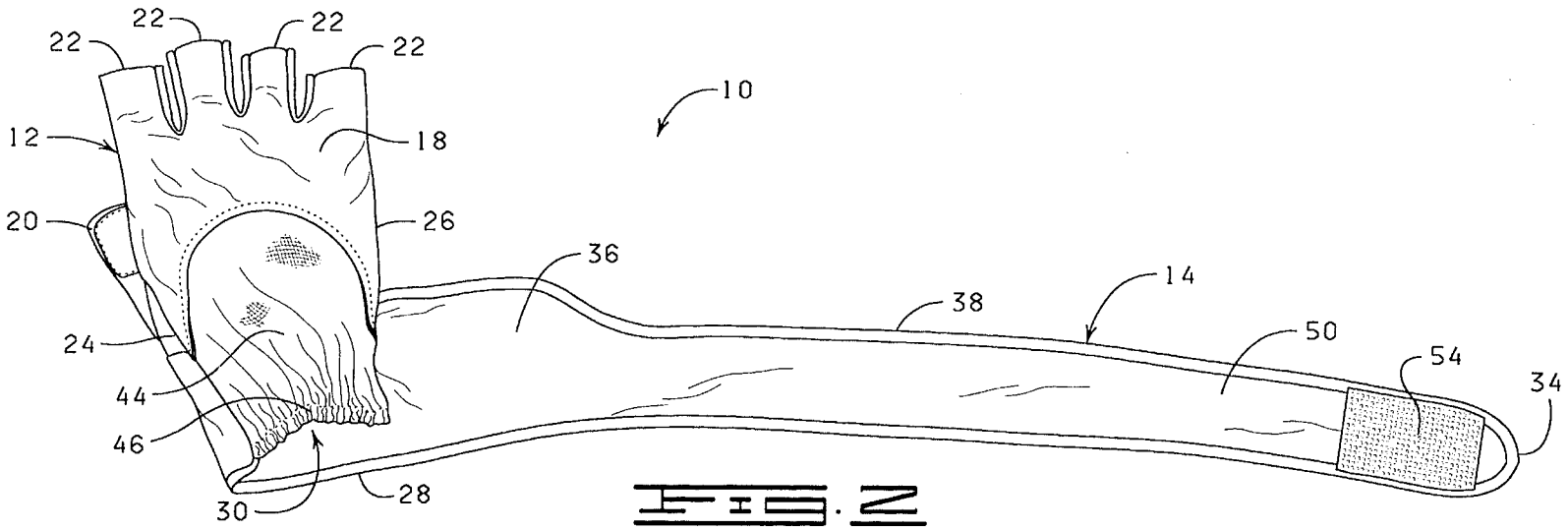
FIG. 2 is a back side view of the weight-lifting glove of FIG. 1.

Referring to the drawings in general, and to FIGS. 1 and 2 in particular, shown therein and designated by the general reference numeral 10 is a weight-lifting glove, which includes a glove member 12 and a strap 14.

The glove member 12 comprises a palm side 16, a back side 18, a thumb stall 20, four finger stalls 22, a thumb side 24, a little finger side 26 and a wrist end 28. As best seen in FIG. 2, the wrist end 28 has a glove opening 30 for insertion of a wearer's hand into the glove member 12.

Typically, each one of the finger stalls 22 has an open end and a length such that each finger of the glove-wearer is bare from the finger tip to a point between the knuckle and the first finger joint of the finger. However, the glove member 12 may be constructed such that some or all of the finger stalls 22 have any length, from no length at all to full-finger length. Full length finger stalls 22 may be close-ended rather than open-ended.

In similar fashion, the thumb stall 20 typically has an open end and a length such that the thumb of the glove-wearer protrudes from the thumb stall 20. However, the glove member 12 may be constructed such that the thumb stall 20 has any length between full length and no length. A full length thumb stall 20 may be close-ended rather than open-ended.

The palm side 16 of the glove member 12 may be padded substantially as shown in FIG. 1, or in any other suitable manner. Typically, the glove member 12 is padded with foam rubber or the like stitched into the palm side 16 of the glove member 12.

The strap 14 has an attached end 32, a free end 34, a back-of-the wrist portion 36 and a running portion 38. The attached end 32 of the strap 14 is secured to the little finger side 26 of the glove member 12, substantially as shown in FIG. 1.

As illustrated by FIGS. 1 and 2, the back-of-the-wrist portion 36 is wider than the running portion 38 of the strap 14. With this construction, the back-of-the-wrist portion 36 provides a wide area of support to the back side of the glove-wearer's wrist.

On the palm side 16, the glove member 12 includes a sleeve 40 which extends from the base of the thumb stall 20 to the little finger side 26 of the glove member 12, substantially as shown in FIG. 1. The sleeve 40 and the palm side 16 of the glove member 12 define a sleeve opening (indicated by arrow 42) therebetween. The sleeve opening 42 is sized and shaped to receive the running portion 38 of the strap 14.

Typically, the sleeve 40 is a piece of leather or the like which is stitched to the glove member 12 at the base of the thumb stall 20 and along tile little finger side 26 of the glove member 12. However, the sleeve opening 42 may be provided in a wide variety of ways.

For example, the sleeve opening 42 may be provided in the form of a pair of slits (not shown) in the palm side 16 of the glove member 12 itself. In this embodiment, the portion of the glove member 12 between the two slits defines the sleeve 40 and sleeve opening 42 and the slits should be long enough to receive the running portion 38 of the strap 14.

On the back side 18, the glove member may have a flexible fabric panel 44. At the wrist end 28 of the glove member 12, the fabric panel 44 may be gathered and provided with an elastic strip 46 in order to conform to the hand of the glove-wearer.

The running portion 38 of the strap 14 has a first side 48 (visible in FIG. 1) and a second side 50 (visible in FIG. 2). A first fastening strip 52 is secured to the first side 48 of the strap 14 substantially as shown in FIG. 1.

A second fastening strip 54 is secured to the second side 50 of the strap 14 substantially as shown in FIG. 2. The first and second fastening strips 52 and 54 are typically made of complementary strips of hook and loop fasteners, such as Velcro® or the like.

Typically, the glove member 12 and the strap 14 are constructed of leather or the like. However, the glove member 12 and strap 14 may be made of any material which has properties consistent with the purpose of the present invention.

USE OF THE WEIGHT-LIFTING GLOVE

The use of the weight-lifting glove 10 is illustrated by FIGS. 3 through 7. In putting on the glove 10, the hand of a wearer is inserted through the glove opening 30 and into the glove member 12 such that the thumb extends into the thumb stall 20 and each one of the fingers extends into a respective one of the finger stalls 22.

Figure 3:
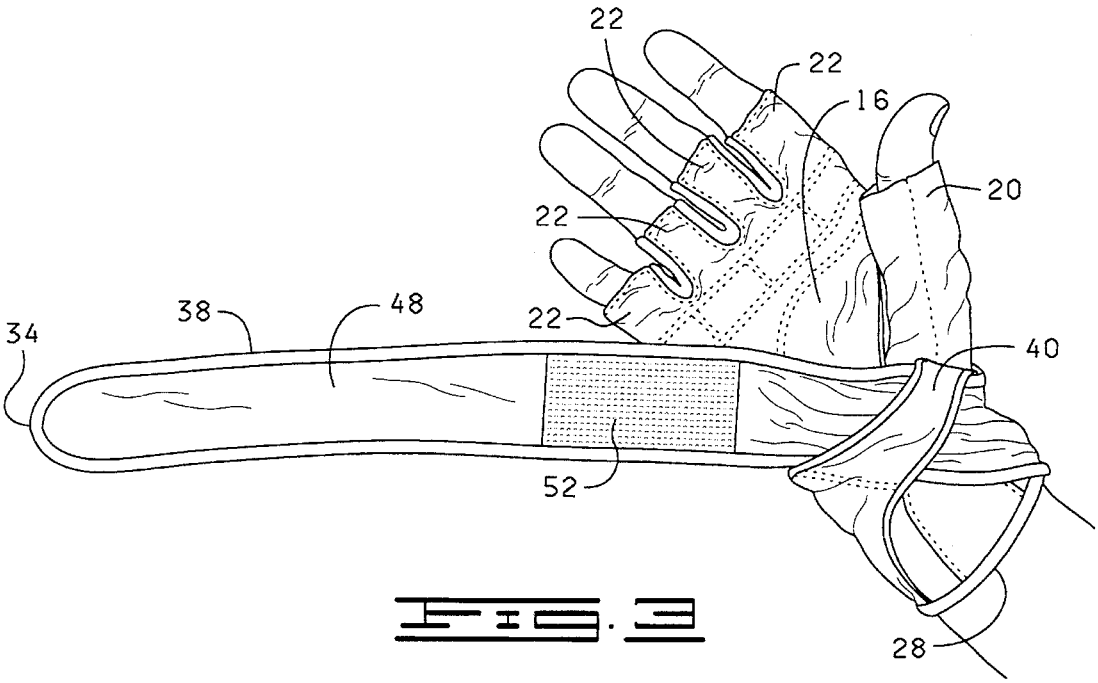
FIG. 3 is a palm side view of the weight-lifting glove applied to the hand of the wearer.

Next, the back-of-the-wrist portion 36 of the strap 14 wrapped around the back of the wrist and the running portion 38 of the strap 14 is pulled through the sleeve 40 substantially as shown in FIG. 3. In this manner, the strap 14 supports the wrist from the back of the wrist and angularly across the heel of the hand.

Figure 4:
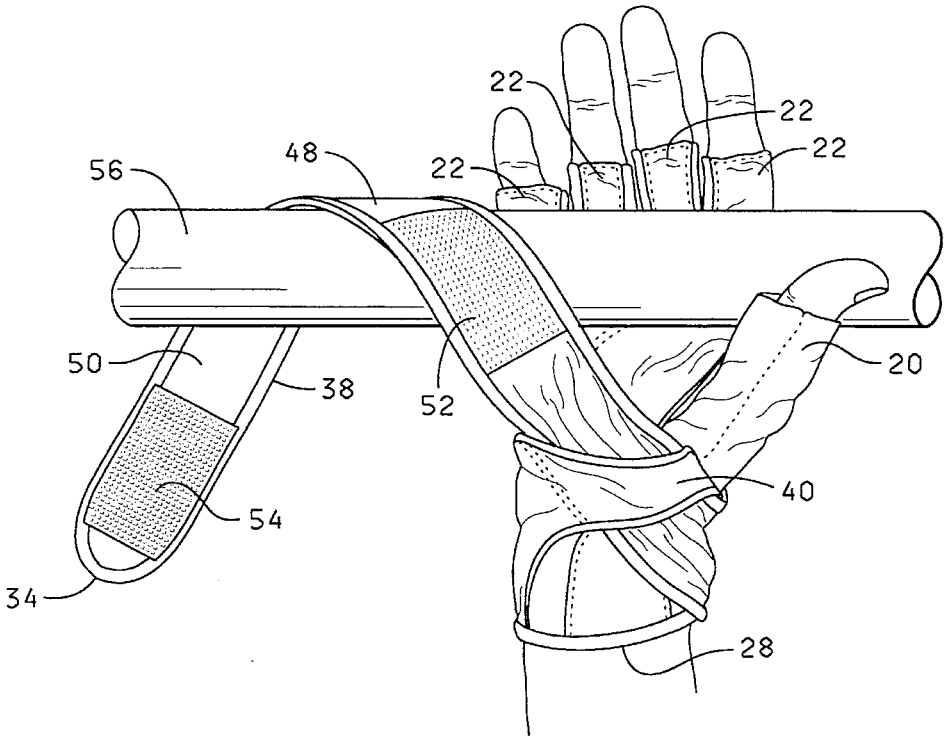
FIG. 4 is a palm side view of the weight-lifting glove applied to the hand of the wearer and partly applied to the bar of a weight to be lifted.
Figure 5:
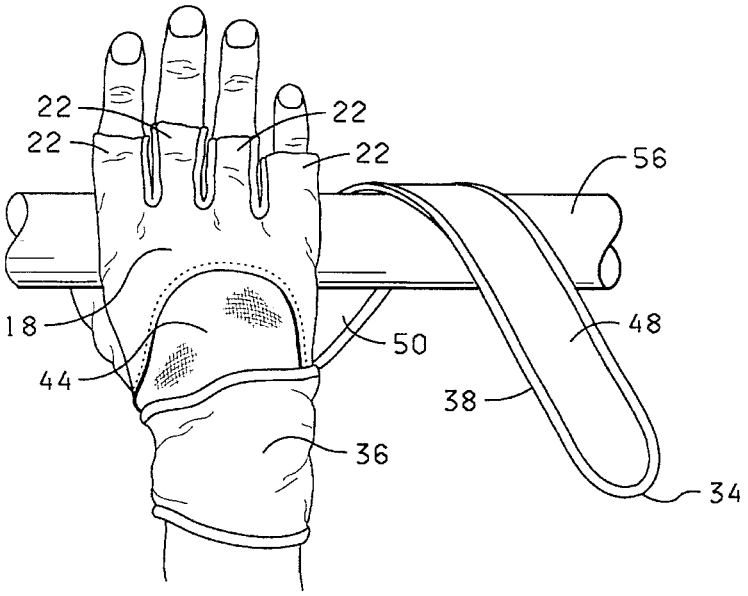
FIG. 5 is a back side view of the weight-lifting glove applied to the hand of the wearer and partly applied to the bar of a weight to be lifted.

After the glove 10 is in place on the hand of the wearer, the running portion 38 of the strap 14 may be secured to the bar 56 of a weight to be lifted. The running portion 38 of the strap 14 is wrapped around the bar 56 with the first side 48 of the strap 14 to the outside, substantially as shown in FIGS. 4 and 5.

Figure 6:
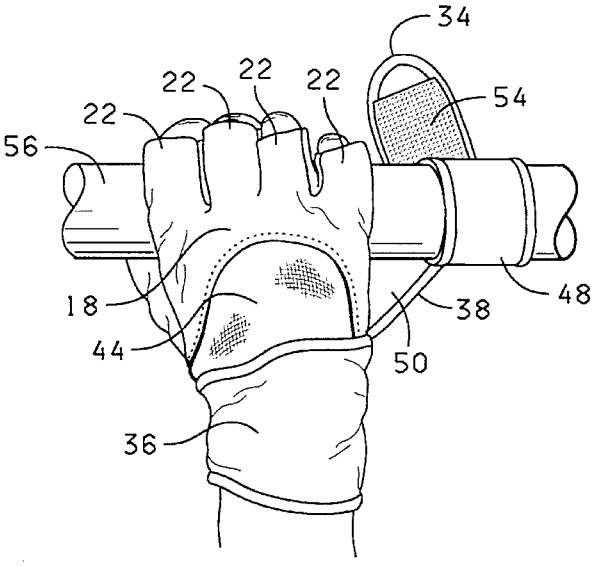
FIG. 6 is a back side view of the weight-lifting glove completely applied to the hand of a wearer and the bar of a weight to be lifted by the wearer.
Figure 7:
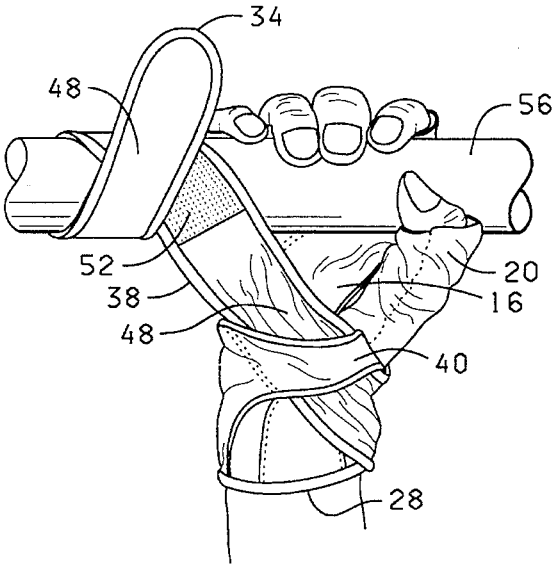
FIG. 7 is a palm side view of the weight-lifting glove completely applied to the hand of a wearer and the bar of a weight to be lifted by the wearer.

As illustrated by FIGS. 6 and 7, the hand of the glove-wearer and the wrap of the strap 14 are snugged to the bar 56 of the weight to achieve the tightness desired by the glove-wearer. Then the second fastener strip 54 is placed in contact with the first fastener strip 52 to secure the strap 14. With the (hook and loop fasteners, such as Velcro®) strip fasteners 52 and 54, the strap 14 is easily released, adjusted and secured.

It should be appreciated that the strap 14 may be wrapped around the bar 56 of a weight in a wide variety of ways. For example, the strap 14 may be wrapped in any overlapping fashion before being secured to the bar 56 with the fastener strips 52 and 54.

Further, the use of the weight-lifting glove 10 is not limited to use in lifting dead weights. An individual may use the weight-lifting glove 10 for a secure grip on the handles of fitness or body conditioning apparatus, the handle-bars of motorcycles, bicycles and exercise bicycles, and the oars of rowing craft or rowing machines. In short, the weight-lifting glove 10 may be used wherever a secure grip is needed.

The weight-lifting glove 10 described and illustrated hereinabove is a right-handed glove. However, it should be appreciated that the present invention contemplates and includes a left-handed weight-lifting glove constructed in a manner consistent with the disclosure made herein.

Changes may be made in the combinations, operations and arrangements of the various parts and elements described herein without departing from the spirit and scope of the invention as defined in the following claims.

What is claimed is:

1. A glove adapted to be disposed over an individual's hand and wrist for supporting the wrist when gripping an object, the glove comprising:

a glove member having a palm side, a back side, and an opening for receiving the hand of the individual;

sleeve means for defining a sleeve opening on the palm side of the glove member; and a strap having one end connected to the glove member, a free end, a back-of-the-wrist portion and a running portion, the back-of-the-wrist portion being wrappable about the back of the wrist and the running portion being disposed through the sleeve opening of the sleeve means so as to be disposed adjacent the palm side of the glove member and extend angularly across the heel of the hand whereby the disposition of the back-of-the wrist portion and the running portion of the strap cooperate to provide support to the wrist of the individual, the running portion of the strap member having a length sufficient to permit the running portion of the strap to be disposed about and secured to the object whereby the glove member is connected to the object so as to enhance the individual's grip on the object.

2. The glove of claim 1 further comprising:

fastening means secured to the running portion of the strap for releasably connecting the strap to an object to be gripped.

3. The glove of claim 2 wherein the strap member is further characterized as having a first side and a second side and wherein the fastening means comprises:

a first fastening strip secured to the running portion of the strap so as to be disposed on the first side of the strap; and a second fastening strip secured to the running portion of the strap so as to be disposed on the second side of the strap near the free end of the strap, the first and second fastening strips connectable together for connecting the running portion of the strap to the object.

4. The glove of claim 1 wherein the back-of-the-wrist portion of the strap is wider than the running portion of the strap and the running portion of the strap has a substantially uniform width.

5. The glove of claim 1 further comprising:

a plurality of finger stalls; and a thumb stall.

6. The glove of claim 5 wherein each one of the finger stalls is open-ended.

7. The glove of claim 5 wherein the thumb stall is open-ended.

8. The weight-lifting glove of claim 1 further comprising:

a cushion pad secured to the glove member so that the cushion pad is disposed on the palm side of the glove member.

* * * * *